United States Patent [19]

Honour

[11] 4,170,551

[45] Oct. 9, 1979

[54] WASTE OIL RECOVERY UNIT

[75] Inventor: David Honour, London, England

[73] Assignee: The British Petroleum Company Limited, London, England

[21] Appl. No.: 850,914

[22] Filed: Nov. 14, 1977

[30] Foreign Application Priority Data

Nov. 18, 1976 [GB] United Kingdom ..... 48076/76

[51] Int. Cl.[2] ..... C02B 9/02; E02B 15/04

[52] U.S. Cl. ..... 210/27; 210/40; 210/73 W; 210/179; 210/187; 210/197; 210/DIG. 26

[58] Field of Search ..... 210/40, 72, 73 W, 136, 210/137, 152, 167, 179, 181, 187, 197, DIG. 26, 27, 265, 266

[56] References Cited

U.S. PATENT DOCUMENTS

| | | | |
|---|---|---|---|
| 2,940,594 | 6/1960 | Binmore | 210/187 |
| 3,554,713 | 1/1971 | Bassett et al. | 114/74 R |
| 3,565,252 | 2/1971 | Sheehy et al. | 210/197 |
| 3,618,777 | 11/1971 | Meyer | 210/137 |
| 3,996,136 | 12/1976 | Jakubek et al. | 210/73 W |
| 4,061,573 | 12/1977 | Biron | 210/DIG. 26 |

FOREIGN PATENT DOCUMENTS

| | | |
|---|---|---|
| 983060 | 2/1965 | United Kingdom . |
| 1235833 | 6/1971 | United Kingdom . |

*Primary Examiner*—Charles N. Hart
*Assistant Examiner*—Ivars Cintins
*Attorney, Agent, or Firm*—Morgan, Finnegan, Pine, Foley & Lee

[57] ABSTRACT

Waste oil on board ship is disposed of usefully by burning in the ship's steam raising boiler. Apparatus for rendering the waste oil burnable comprises a tank with waste oil and fuel oil and fuel oil inlets, a tank heater, a drain pipe and filter for separated water, an agitator, an external pipe and pump and pump for recirculation of waste oil and fuel oil through the turn and a bleed off pipe from the external pipe to the ship's boiler fuel supply line. Other liquid or finely powdered organic waste (e.g. kitchen waste) may also be disposed of in the system.

8 Claims, 1 Drawing Figure

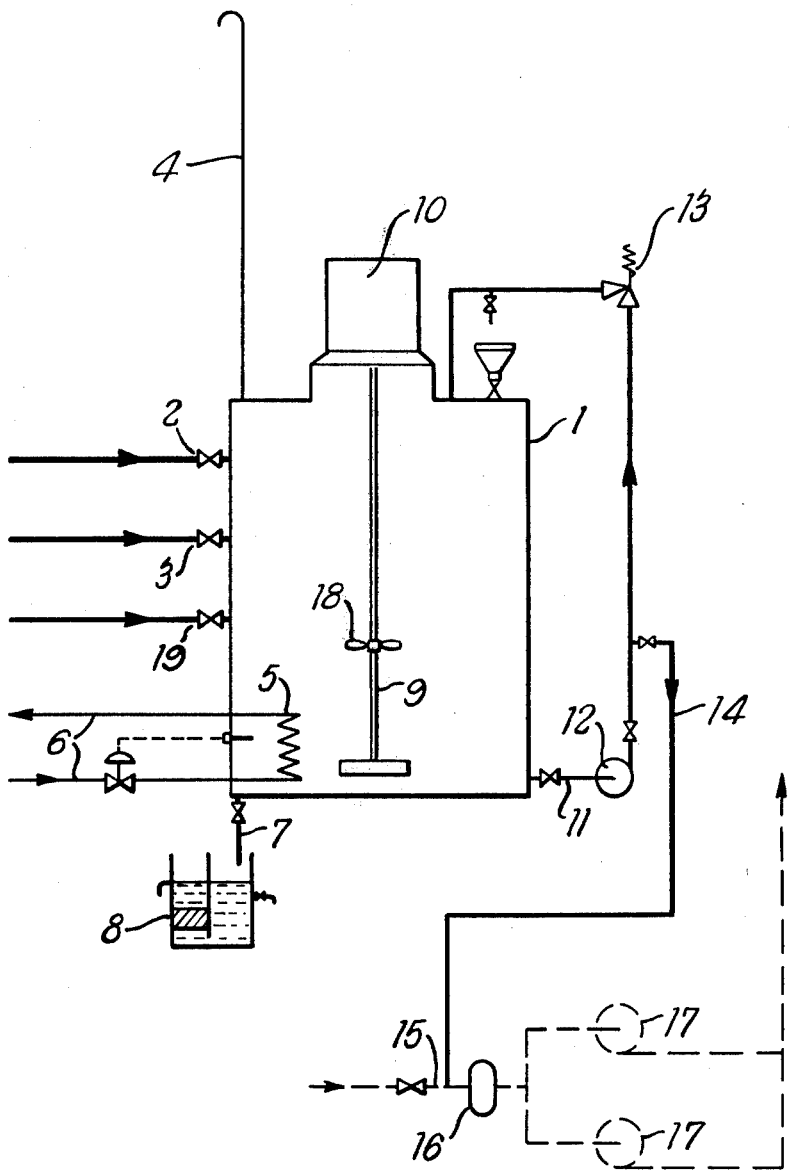
4
10
13
2
1
3
18
19
5
9
14
12
6
11
7
8
15
17
16
17

WASTE OIL RECOVERY UNIT

This invention relates to an apparatus and method for treating waste oils on board ships, particularly oil tankers, to enable the waste oil to be disposed of by burning in the ships' boilers.

Waste oil and oily sludges can be accumulated on board ship in considerable quantities, and with environmental standards prohibiting the discharge of oil into the sea there is a need for a simple method of an board disposal. The waste to be disposed of can be oily sludge from centrifugal separators, with its relatively high water content; it may be spent lubricating oil from main or auxiliary machinery; it may be oil drained from scavenge air belts or piston underside drains containing carbon or other particulate matter; or it might be the oil skimmed from oily water bilge separators.

Up till now this waste oil has had to be retained on board ship and then discharged at a port with facilities for handling and disposing of it. Alternatively, relatively expensive incinerators have had to be installed on board. It has now been found that, if suitably treated and handled, all the above forms of waste oil can be disposed of by burning in the main furnaces of existing ships' boilers using only the standard oil burning equipment. Apparatus for treating and handling the waste oil to enable it to be so disposed of has also been designed.

According to the present invention apparatus for treating waste oil on board ship to render it suitable for burning in ships' boilers comprises a tank having a waste oil inlet and a fuel oil inlet, a heater and an agitator within the tank, on outlet near the base connected to an oil absorbent filter, an external pipe from near the base to near the top of the tank with a circulating pump, and a branch from the pipe to the ships' boiler fuel supply line.

The invention includes a method of treating waste oil on board ship to render it suitable for burning in ships' boilers using the apparatus described above comprising holding waste oil in the tank at above atmospheric temperature to allow water to separate, withdrawing the water through the outlet and oil absorbent filter, optionally adding fuel oil to the remaining waste oil, agitating the contents of the tank to suspend and disperse non-dissolved solids and liquids, stopping the agitation, recirculating the contents of the tank through the external pipe and bleeding off waste oil from the pipe to the ships' boiler fuel supply line.

The apparatus and method may be used to any ship having a suitable boiler. Even motor driven ships are likely to have a boiler for driving auxiliary equipment and a preferred use of the apparatus and method is on motor ships driven by relatively heavy diesel engines. Centrifugal separators are normally used to treat the fuel for the engines, and they remove about 1% of sludge, which can then be disposed of according to the present invention.

The invention will be further described with reference to the accompanying drawing which is a diagrammatic representation of a waste oil treatment system.

In the drawing, the system comprises a tank 1 with a valved waste oil inlet 2, a valved fuel oil inlet 3, and a vent pipe 4 to atmosphere. A heating coil 5 is supplied with steam through pipes 6. Valved outlet 7 near the base leads to filter 8 containing an oil absorbent filter material. The tank has an agitator 9 driven by a motor 10. Pipe 11 leads from near the base of the tank through a recirculating pump 12 and spring-loaded valve 13 to the top of the tank and a branch 14 from pipe 11 leads to the main fuel oil supply line 15 of the ships' boilers, the line having, according to normal practice, a filter 16 and pumps 17.

In operation, the waste oil is pumped through inlet 2 into the tank and is allowed to settle under the influence of heat supplied by coil 5. The temperature should obviously not exceed 100° C. and may conveniently be from 50° to 80° C. The heating is desirable to increase the fluidity of the waste oil and encourage the separation of water which collects at the base of the tank. After a period of heating and settling, typically between 2 and 6 hours, free water is drained from the bottom of the tank through filter 8 containing oil absorbent material. Only free water is drained off; at the first appearance of oil droplets, draining is stopped. Water leaving the filter is relatively free of oil and may be run back to bilge for eventual transfer overboard via a conventional oily bilge water separator. Any oil accumulating in the filter can be recovered and returned into the tank.

After the free water has been drained off, fuel oil may be added through inlet 3 to the waste oil remaining in the tank. The quantity of fuel added will depend upon the nature of the waste being treated and also upon the viscosity and calorific value of the fuel oil added. Heating may be maintained during the fuel oil addition and the subsequent agitation and recirculation periods.

In general the amount of fuel oil added may be from one to two volumes of fuel oil/volume of waste oil. At any stage additives may also be introduced into the tank, if necessary, to break down difficult sludges or to promote good combustion. The type of additives that could be used include flow improvers, emulsifiers, smoke suppressants, deposit modifiers, and corrosion inhibitors.

The combined waste oil and fuel oil contents of the tank, are then homogenised and emulsified by the agitator 9 possessing high shear qualities. An auxiliary propeller 18 may also be fitted to the agitator shaft in order to help promote good circulation in the tank. Simple tests carried out at intervals during the agitating process for viscosity, free water content and unacceptable particle size may be used to determine when the mixture is suitable for burning in the standard combustion equipment fitted to the boiler. With the usual types of waste oil, the period of agitation may be from one to three hours.

When an acceptable quality has been reached, the agitator 9 is stopped and the recirculating pump 12 started. This pump, which is of a type having emulsifying and mixing properties, draws from the bottom of the tank through line 11 and discharges through spring loaded valve 13 to the top of the tank. The spring loaded valve imposes a back pressure of sufficient magnitude on the recirculating pump, to enable oil tapped off through line 14 to overcome the pressure head prevailing at inlet 15 to the ships' boiler oil pressure pump system. Treated waste oil can then be blended into the normal supply of fuel from the ship's service tanks to the boilers or can even be used by itself as fuel for the boiler. The rate of recirculation through line 11 may vary considerably depending on the ship, the type of waste oil, and the size of tank 1. By way of illustration only, the rate may be from 80 liters to 200 liters/min. The rate of draw off through line 14 will depend on the consumption rate of the boiler and may also vary widely from ship to ship and time to time.

A connection 19 may be provided for admitting sewage and finely ground organic kitchen wastes from the ship's sewage and kitchen waste disposal systems. These wastes can be treated, when required, with the waste oil for blending into the normal supply of fuel, from the ship's service tanks, for the boiler.

In a specific example, tank 1 had a capacity of 1000 liters. Waste oil and water from the fuel and lubricating oil centrifugal separators was pumped into the tank and allowed to settle for four hours at 60° C. before draining off separated water. An equal volume of 1800 seconds fuel oil/vol. of waste oil was then added and the mixture was agitated for three hours. The agitator incorporated a special cutting/disintegrating head supplied by Peter Silver Ltd., rotating at 3600 rpm and driven by a 7.5 h.p. electric motor. When the viscosity had reached approximately 600 seconds Redwood 1 (at 60° C.) the agitator was stopped and the mixture was recirculated at a rate of 160 l/m against a back pressure in value 13 of 3 atmospheres. The recirculating pump was of hypocycloidal design, being Mono type SH60R6, supplied by F. A. Hughes & Co. Ltd. The mixture was fed to the ship's boiler system at rates varying between 2.6 and 17 liters/min. and the mixture formed between 15–100% volume of the fuel oil fed to the boilers. Firing of the boilers on fuel containing waste oil continued for 3¾ hours without any malfunctioning or accumulation of deposits in the boilers or burners.

In a long term trial, a unit as described in FIG. 1 was use on an operational oil tanker for 11 months. The tanker was of 25,000 dead weight tons and the main propulsion engine was a slow speed diesel engine built by Societe Anonyme Cockerill of Belgium and running on high viscosity fuel (3,500 seconds Redwood No. 1, maximum at 100° F.). All the waste oil generated in the engine room, amounting to between 0.5 and 1.0% of fuel consumed, was passed through a unit as described in FIG. 1 and burnt in the main steam-raising boiler. This main boiler was of the dual pressure, water-tube type, burning high viscosity fuel (3500 seconds Redwood No. 1 maximum at 100° F.) in the furnace of the primary section. The burners were steam assisted pressure jet burners working at fuel pressures of up to 30 bars, and the boiler had two main and one pilot burner to give a maximum steam output of 27.5 tonnes per hour while burning 2360 kilograms of fuel per hour.

During the 11 months of operation, no additional maintenance was incurred as a result of burning the waste oil; boiler tube, burner and register fouling were no worse than normal, while burner tip wear and fuel filter blockage did not increase to any noticable extent. Neither did the limited amount of brickwork and refractory in the boiler deteriorate during the period.

The above description is purely illustrative and the unit of the present invention is considered suitable for use with any type of boiler and any type of burner (including spinning cup burners) burning medium to high viscosity fuel.

I claim:

1. Apparatus for treating waste oil on board ship to render said waste oil suitable for burning in a ship's boiler comprising: a tank having a waste oil inlet and a fuel oil inlet, a heater and an agitator within the tank, an outlet at the base of said tank which is connected to an oil absorbent filter, an external pipe which extends from the base of said tank to the top of the tank, said external pipe being provided with a circulating pump, and a branch pipe which extends from the external pipe to a ship's boiler fuel supply line, so that said waste oil can be directed to said ship's boiler for burning.

2. An apparatus as claimed in claim 1 wherein the heater is a steam heating coil.

3. Apparatus as claimed in claim 1 wherein the external pipe has a spring-loaded valve in it.

4. A method of treating waste oil comprising: introducing said waste oil into a tank; holding said waste oil in the tank at above atmospheric temperature to allow water to separate from the waste oil; withdrawing water from said tank through an outlet and passing said water through, thereafter agitating the contents of the tank to suspend and disperse non-dissolved solids and liquids; stopping the agitation; then recirculating the contents of the tank through an external pipe; bleeding off waste oil from the external pipe; and passing said waste oil to a ship's boiler fuel supply line.

5. A method as claimed in claim 4 wherein the temperature in the tank is from 50° to 80° C.

6. A method as claimed in claim 4 wherein from 1 to 2 volumes of fuel oil/volume of waste oil are added prior to agitation and recirculation.

7. A method as claimed in claim 4 wherein the external pipe has a spring loaded valve in it and the valve imposes a back pressure sufficient to overcome the pressure head prevailing at the inlet to the ship's boiler oil pressure pump system.

8. A method as claimed in claim 4 wherein fuel oil is added to said tank after the water is withdrawn.

* * * * *

UNITED STATES PATENT OFFICE

CERTIFICATE OF CORRECTION

Patent No. 4,170,551 Dated October 9, 1979

Inventor(s) David Honour

It is certified that error appears in the above-identified patent and that said Letters Patent are hereby corrected as shown below:

Col. 1, line 11, change "an" to -- on--;

Col. 3, line 30, change "use" to -- used --;

Col. 4, line 31, after "through" insert -- an oil absorbent filter; --.

Signed and Sealed this

*Eighth* Day of *January 1980*

[SEAL]

*Attest:*

SIDNEY A. DIAMOND

*Attesting Officer*

*Commissioner of Patents and Trademarks*